US007786947B2

(12) United States Patent
Bae et al.

(10) Patent No.: US 7,786,947 B2
(45) Date of Patent: Aug. 31, 2010

(54) BROADBAND ANTENNA

(75) Inventors: Seok Bae, Gyunggi-Do (KR); In Young Kim, Gyunggi-Do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 366 days.

(21) Appl. No.: 11/846,868

(22) Filed: Aug. 29, 2007

(65) Prior Publication Data

US 2008/0055176 A1 Mar. 6, 2008

(30) Foreign Application Priority Data

Aug. 30, 2006 (KR) ..... 10-2006-0083106

(51) Int. Cl.
*H01Q 11/06* (2006.01)
*H01Q 1/00* (2006.01)

(52) U.S. Cl. ..... 343/787; 343/700 MS; 343/792.5; 343/846; 343/895

(58) Field of Classification Search ..... 343/700 MS, 343/787, 846, 895, 792.5
See application file for complete search history.

(56) References Cited

U.S. PATENT DOCUMENTS 6,650,291 B1 * 11/2003 West et al. ..... 342/371
6,967,624 B1 * 11/2005 Hsu et al. ..... 343/770
6,987,488 B1 * 1/2006 Chang et al. ..... 343/767
7,088,300 B2 * 8/2006 Fisher ..... 343/767
7,388,544 B2 * 6/2008 Bit-Babik et al. ..... 343/702
7,446,627 B2 * 11/2008 Hacker et al. ..... 333/125
2005/0024282 A1 * 2/2005 Apostolos ..... 343/767
2006/0158865 A1 * 7/2006 Ohmi et al. ..... 361/795

FOREIGN PATENT DOCUMENTS

JP 5218726 A 8/1993

* cited by examiner

*Primary Examiner*—Douglas W Owens
*Assistant Examiner*—Chuc D Tran
(74) *Attorney, Agent, or Firm*—Lowe Hauptman Ham & Berner LLP

(57) ABSTRACT

There is provided a broadband antenna including: an insulating block having opposing first and second main surfaces and a side surface between the first and second main surfaces; a first radiator pattern formed on the first main surface and having a tapered slot with an open end; and a second radiator pattern including two patterns connected to opposing ends of the first radiator pattern, respectively, and extending to the second main surface.

11 Claims, 12 Drawing Sheets

BROADBAND ANTENNA

CLAIM OF PRIORITY

This application claims the benefit of Korean Patent Application No. 2006-0083106 filed on Aug. 30, 2006, in the Korean Intellectual Property Office, the disclosure of which is incorporated herein by reference.

BACKGROUND OF THE INVENTION

1. Field of the Invention

The present invention relates to a broadband antenna, and more particularly, to an antenna having broadband characteristics in a low frequency band.

2. Description of the Related Art

Recently, mobile communication terminals are diversified in the frequency ranges with advancement in wireless communication technology. In particular, the frequency bands currently used in the wireless communication include: 800 MHz to 2 GHz for global system for mobile communication (GSM) and code division multiple access (CDMA) mobile phones; 2.4 GHz and 5 GHz for wireless local area network (WLAN); 13.56 MHz, 433.92 MHz, 908 to 914 MHz, 2.45 GHz for non-contact radio frequency identification (RFID); 2.4 GHz band for Bluetooth; 1.575 GHz for global positioning system (GPS); 88 to 108 MHz for FM radio; 475 to 750 MHz for digital video broadcasting-handheld (DVB-H); and 175 to 225 MHz for ground wave digital multimedia broadcasting (DMB), ultra wide band (UWB) and Zigbee.

In general, it is possible to manufacture and mount a small-sized antenna, having a frequency range of 1 GHz or higher, in a mobile communication terminal by typical design technology. However, a VHF antenna of a low frequency range (e.g. hundreds of MHz band), in particular, an antenna for ground wave DMB requires tens of centimeters of length for ensuring a resonant frequency, and thus is not suitable to be mounted in the mobile communication terminal.

The broadband antennas currently under development include a horn antenna and a log periodic antenna, which however are not small enough to be mounted internally and have high directivity, thus not suitable for mobile communication terminals such as mobile phones. Other broadband antennas having omni-directional radiation characteristics while having a small size include a slot antenna, a meander line antenna, a spiral antenna, a loop antenna and the like. However, there does not exist a small (e.g. about 1 $cm^3$) antenna capable of covering a broad band of 475 to 750 MHz to date.

Further, there is no single built-in antenna, which can realize both T-DMB (174 to 216 MHz) and DVB-H (475 to 750 MHz) to date.

SUMMARY OF THE INVENTION

An aspect of the present invention provides an antenna readily miniaturized while having broadband characteristics in a low frequency range.

According to an aspect of the invention, there is provided a broadband antenna including: an insulating block having opposing first and second main surfaces and side surfaces between the first and second main surfaces; a first radiator pattern formed on the first main surface and having a tapered slot with an open end; and a second radiator pattern including two patterns connected to opposing ends of the first radiator pattern at the side of the open end of the slot, respectively, and extending to the second main surface.

The first and second radiator patterns may be symmetrical about a direction in which the slot is formed as a reference axis.

The two patterns of the second radiator pattern may be disposed in parallel to each other. Alternatively, the two patterns of the second radiator pattern have an interval widening in an opposite direction from the open end of the slot.

The first radiator pattern may have a width increasing toward the open end of the slot in a V-shape. In this case, a feeding portion may be provided in an area adjacent to a tip of the first radiator pattern.

Alternatively, a feeding portion may be provided at one end of the two patterns of the second radiator pattern.

The first radiator pattern may have at least one pair of log-periodic patterns formed in opposing positions of opposing sides thereof. If necessary, the second radiator pattern may have portions extending to the side surfaces of the insulating block.

The insulating block may be formed of, but not limited to, a compound material of a polymer resin containing magnetic material powder, and the compound material has a specific permeability of 2 to 100 and a relative permittivity of 2 to 100. In this case, the magnetic material powder may include at least one selected from a group consisting of Fe, Ni, Co, Mn, Mg, Ba, Sr and Zn.

According to another aspect of the invention, there is provided a broadband antenna including: an insulating block having opposing first and second main surfaces and side surfaces between the first and second main surfaces; a first radiator pattern formed on the first main surface and having a first tapered slot with an open end; and a second radiator pattern formed on the second main surface and having a second tapered slot with an open end at the same side as the first slot, wherein feeding portions are provided at portions of the first and second radiator patterns, respectively.

The first and second radiator patterns may be symmetrical about a direction, in which the slots are formed, as a reference axis.

The first and second radiator patterns may have the same shape in corresponding positions. The first and second radiator patterns may have a width increasing toward the open ends of the slots in a V-shape, respectively. In this case, the feeding portions are formed in areas adjacent to tips of the first and second radiator patterns.

At least one of the first and second radiator patterns may have at least one pair of log-periodic patterns formed in opposing positions of opposing sides thereof.

The insulating block may be formed of a compound material of a polymer resin containing magnetic material powder, and the compound material has a specific permeability of 2 to 100 and a relative permittivity of 2 to 100. In this case, the magnetic material powder may include at least one selected from a group consisting of Fe, Ni, Co, Mn, Mg, Ba, Sr and Zn.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1A:
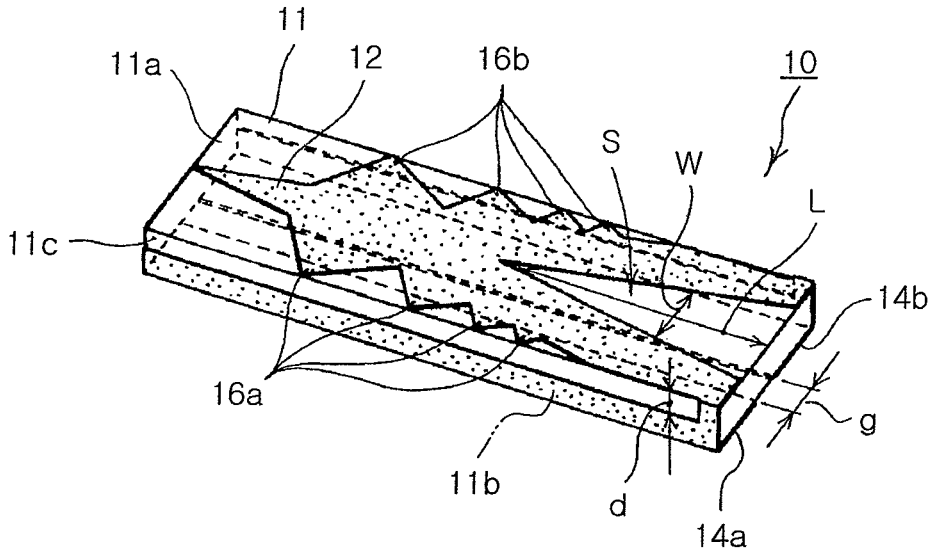
FIGS. 1A and 1B are a perspective diagram illustrating a broadband antenna and a development diagram of an entire radiator pattern of the antenna, respectively, according to an exemplary embodiment of the present invention.
Figure 1B:
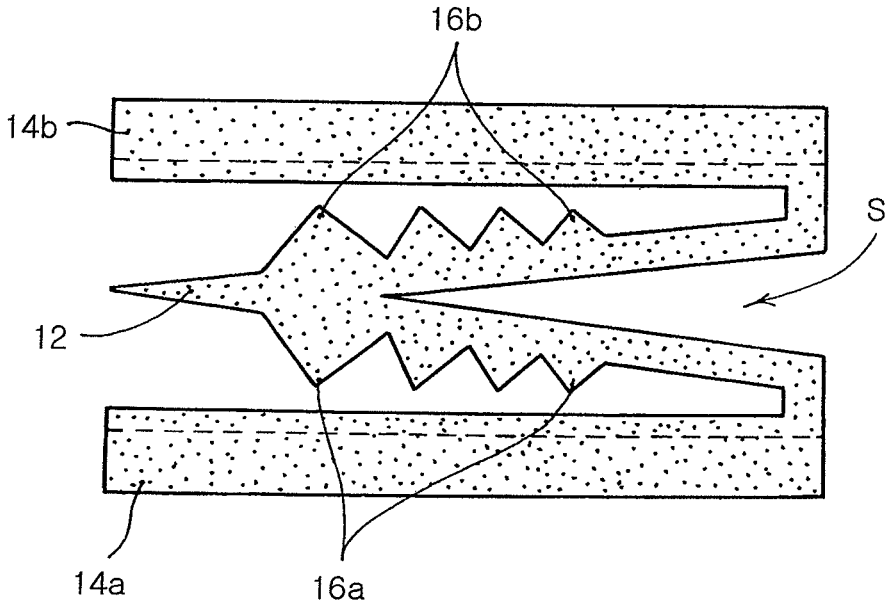

FIG. 1A is a perspective diagram illustrating a broadband antenna according to an exemplary embodiment of the present invention and FIG. 1B is a development diagram illustrating the radiator pattern of the broadband antenna shown in FIG. 1A.

As shown in FIGS. 1A and 1B, the broadband antenna 10 includes first and second main surfaces 11*a* and 11*b* opposing each other; an insulating block 11 having a side surface 11*c* between the first and second main surfaces; and first and second radiator patterns 12, 14*a* and 14*b* formed on the first and second main surfaces 11*a* and 11*b*, respectively.

In this embodiment, the first radiator pattern 12 and the second radiator pattern 14*a* and 14*b* are connected to each other to substantially work as one radiator pattern. As shown, the first and second radiator patterns 12, 14*a* and 14*b* may have a symmetric structure about a direction, in which a tapered slot S is formed, as a reference axis.

The tapered slot S with an open end is formed in the first radiator pattern 12 formed on the first main surface 11*a*. A change of electric field and a decrease of impedance occur along a current path by the tapered slot S formed in the first radiator pattern 12, thereby allowing broadband characteristics of the antenna. In this regard, the slot S employed in the present invention may have an interval w widening toward the open end of the first radiator pattern 12.

In addition, the first radiator has a width increasing toward the open end in a V-shape. Such a radiator pattern may be better than a radiator pattern formed in a relatively larger area on the first main surface 11*a* in terms of bandwidth expansion and antenna gain.

The second radiator pattern includes two patterns 14*a* and 14*b* connected to opposing ends of the first radiator pattern 12 at the side of the open end of the slot, respectively, and extending to the second main surface 11*b*. The two patterns 14*a* and 14*b* of the second radiator pattern may be arranged in parallel to have a constant interval g as shown. However, the present invention is not limited thereto, and the two patterns 14*a* and 14*b* of the second radiator pattern may be formed to have an interval widening in an opposite direction from the open end of the slot. This may enhance the broadband characteristics in a similar manner as the tapered slot S formed in the first radiator pattern 12.

As shown in FIG. 1A, the second radiator pattern 14*a* and 14*b* may have portions extending to the side surface 11*c*. These extending portions increase a total area of the radiator pattern by utilizing the side surfaces 11*c* of the insulating block 11, which is more advantageous in terms of gain characteristics.

However, it should be considered that such extending portions may have disadvantageous effects on the gain characteristics under certain circumstances. For example, when the insulating block 11 has a small thickness, the extending portions and the first radiator pattern 12 have a small distance d from each other. In this case, there may be increased parasitic capacitance component between the extending portions and the first radiator pattern, thereby resultantly heightening the frequency band and decreasing the gain.

In this embodiment, the tapered slot S formed in the first radiator pattern 12 serves to enhance the broadband characteristics. The first radiator pattern 12 with the tapered slot S is connected to the second radiator pattern 14*a* and 14*b* to provide a sufficient electric resonance length, and the first and second radiator patterns 12, 14*a* and 14*b* are formed on the first and second main surfaces 11*a* and 11*b* of the insulating block 11 having a predetermined permittivity to provide a certain capacitance component. Such a capacitance component may advantageously lower the frequency band.

The first radiator pattern 12 employed in this embodiment further includes at least one pair of log-periodic patterns 16*a* and 16*b* to improve the antenna characteristics. The log-periodic patterns 16*a* and 16*b* are formed at opposing positions of the opposing sides of the first radiator pattern.

The insulating block 11 may be formed of, but not limited to, a compound material of a polymer resin and magnetic material powder. Such a compound material may have a specific permeability of 2 to 100, and a relative permittivity of 2 to 100. In this case, the magnetic material powder may include at least one selected from a group consisting of Fe, Ni, Co, Mn, Mg, Ba, Sr and Zn. More particularly, the magnetic material powder may be carbonyl iron. In addition, the polymer resin may be, but not limited to, at least one selected from a group consisting of an epoxy, a phenol resin, a nylon resin and an elastomer, and may be any material having a certain permittivity enabling mixing with the magnetic material powder.

Figure 2A:
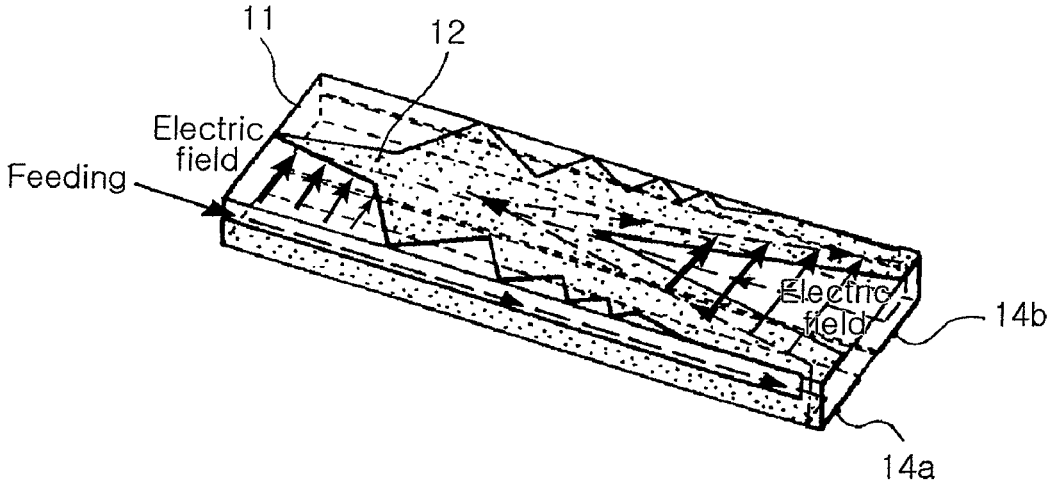
FIGS. 2A and 2B are diagrams illustrating changes in current path according to a feeding location in the broadband antenna illustrated in FIG. 1.
Figure 2B:
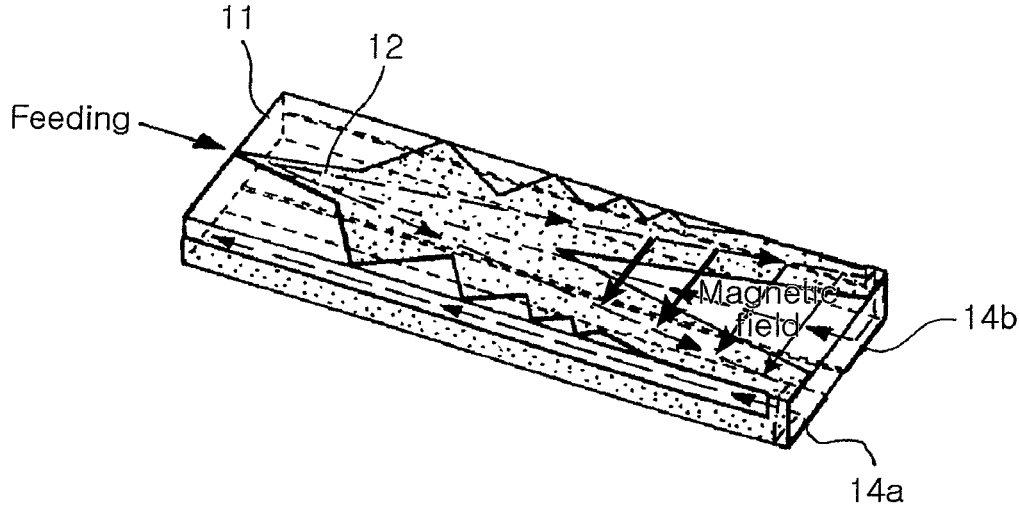

The broadband antenna 10 shown in FIG. 1 may have different frequency characteristics according to a feeding location. FIGS. 2A and 2B illustrate the most representative examples of current paths according to the different feeding locations.

FIG. 2A illustrates a broadband antenna 10, in which one end of the two patterns 14*a* and 14*b* of the second radiator pattern is provided as a feeding portion. In this connection structure, the current flows from one pattern 14*a* of the second radiator pattern via the first radiator pattern 12 to another pattern 14*b* of the second radiator pattern. In this process, as shown in FIG. 2A, an electric field may be generated between the opposing patterns 14*a* and 14*b* of the second radiator pattern, and a change of electric field may occur at the first radiator pattern due to the slot S, thereby realizing broadband characteristics of the antenna.

On the other and, FIG. 2B illustrates a broadband antenna in which a tip of the first radiator pattern 12 is provided as a feeding portion. In this connection structure, the current flows from the tip of the first radiator pattern 12 along the widening width of the slot S to the opposing patterns 14*a* and 14*b* of the second radiator pattern. In this process, as shown in FIG. 2B, a decrease of impedance as well as a change of electric field occur in the slot S region, thereby providing broadband characteristics.

FIGS. 2A and 2B exemplify the most representative feeding locations, but the broadband antenna 10 according to the present invention may realize broadband characteristics regardless of a location of the feeding location. In particular, the embodiment shown in FIG. 2B exemplifies the feeding location at the tip of the first radiator pattern 12, but the feeding location may be adjusted within an area adjacent to the tip of the first radiator pattern, in consideration of the surrounding environment, when actually setting the antenna in a mobile communication terminal.

Figure 3A:
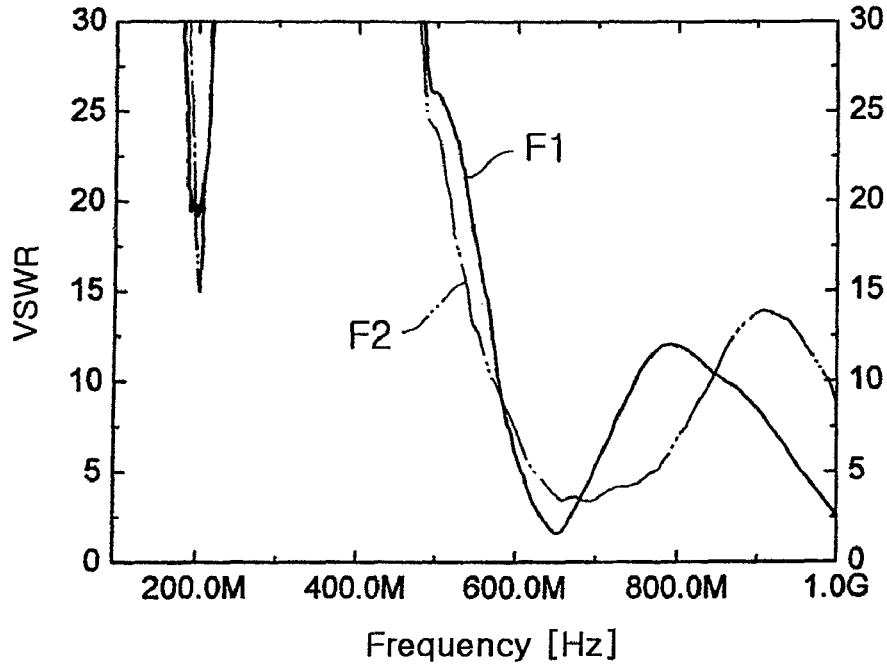
FIGS. 3A and 3B are graphs showing changes in frequency and gains according to a feeding location in the broadband antenna illustrated in FIG. 1.
Figure 3B:
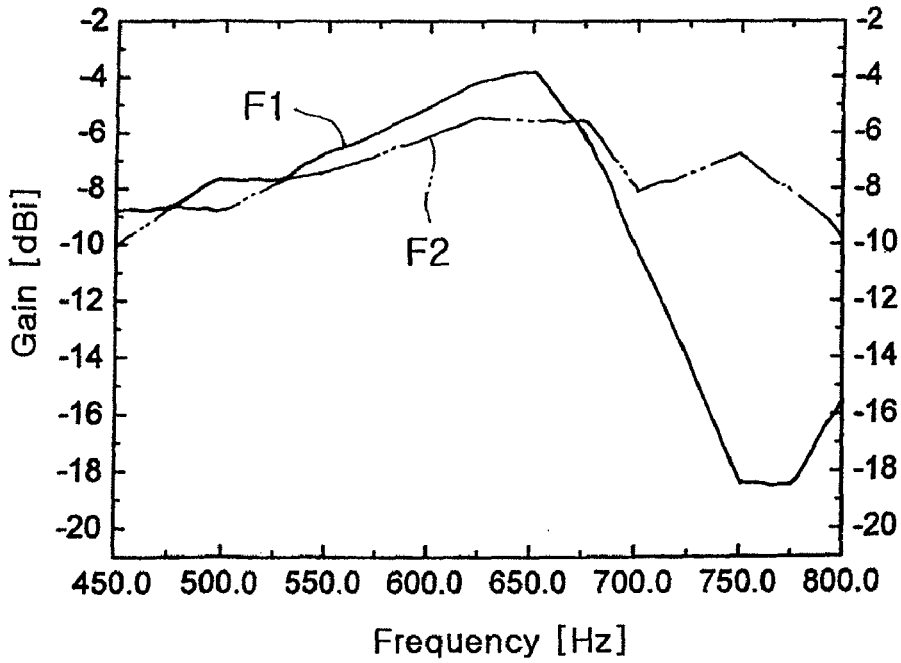

FIGS. 3A and 3B are graphs showing the changes in frequency and gain when the feeding location F1 and F2 varies as shown in FIGS. 2A and 2B.

Referring to FIG. 3A, although manufactured under the same conditions, the antenna having the connection structure of the feeding portion F2 shown in FIG. 2A may be more advantageous than the antenna having the connection structure of the feeding portion F1 shown in FIG. 2B in terms of realizing a low frequency band. This is because as confirmed in FIGS. 2A and 2B, a longer current path is formed in the configuration in which the feeding portion formed at the tip of the first radiator pattern (FIG. 2B, F1) than the configuration in which the feeding portion is formed at one end of the second radiator pattern, thus ensuring a relatively longer resonance length.

In addition, as shown in FIG. 3B, in terms of gain characteristics, the antenna having the connection structure F1 shown in FIG. 2B is better than the antenna having the connection structure F2 shown in FIG. 2A. This result may be understood that the current flow itself is symmetrically formed in a symmetrical antenna structure.

As described above, it is confirmed that, although having common broadband characteristics, the broadband antenna structures according to an exemplary embodiment of the present invention may have different current paths and exhibit different frequency bands and antenna gain characteristics according to the different feeding locations.

Figure 4A:
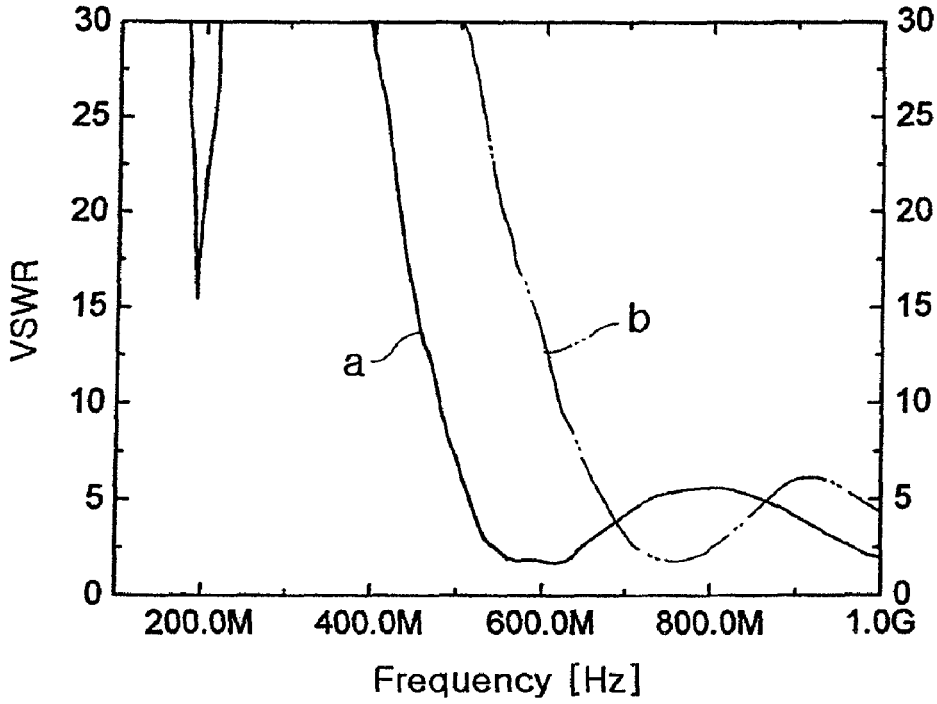
FIGS. 4A and 4B are graphs showing changes in frequency and gains according to a feeding location in the broadband antenna illustrated in FIG. 1.
Figure 4B:
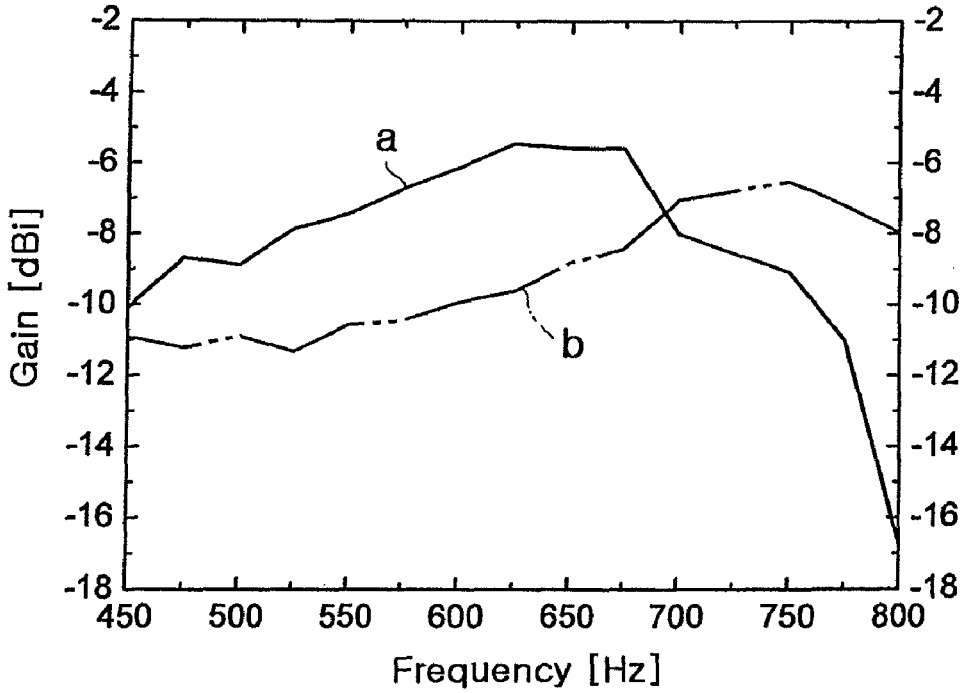

FIGS. 4A and 4B are graphs showing changes in frequency and gain of the broadband antenna shown in FIG. 1 with varying structures of the first radiator pattern. Two samples a and b having the same overall structure as in FIG. 1 but different structures of the first radiator pattern were measured in frequency and gain and the results are indicated in the graphs of FIGS. 4A and 4B.

The sample a is a broadband antenna having the first pattern including a tapered slot and having an overall width increasing toward the open end of the slot in a V-shape, similar to the embodiment shown in FIG. 1. The sample b is a broadband antenna including a tapered slot similar to the embodiment of FIG. 1, but the first radiator pattern is formed on almost the entire first main surface except the slot portion.

First, referring to FIG. 4A, the sample b ensures a broader bandwidth than the sample a, and the sample b allows a lower frequency band than the sample a.

As shown in FIG. 4B, the sample a exhibits lower gain characteristics in a frequency range over 700 MHz, but the sample b exhibits higher gain characteristics in a low frequency band, which is more usefully considered in practice.

Therefore, the first radiator pattern formed in a V-shape with the taper slot is more advantageous than the expanded form of the first radiator pattern not only in terms of frequency characteristics but also gain characteristics.

Figure 5A:
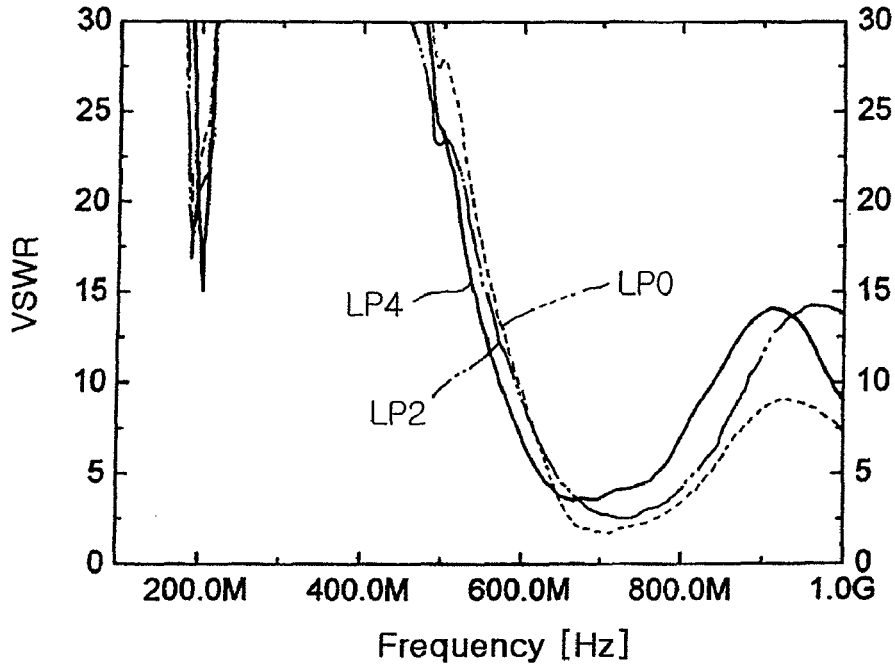
FIGS. 5A and 5B are graphs showing changes in frequency and gains according to the number of log period pattern in the broadband antenna shown in FIG. 1.
Figure 5B:
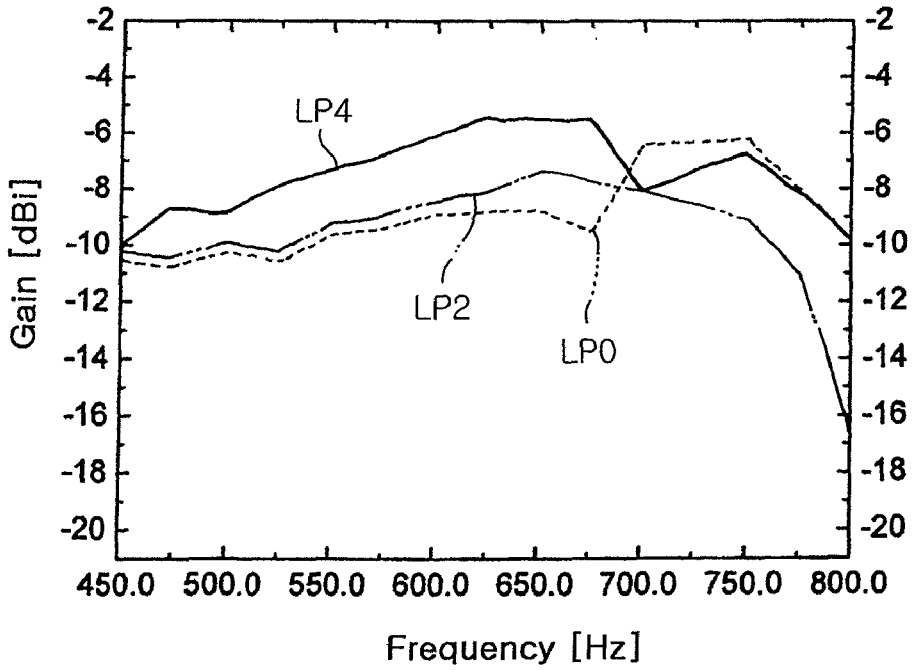

FIGS. 5A and 5B are graphs showing changes in frequency and gain according to the number of log-periodic patterns in the broadband antenna shown in FIG. 1.

A broadband antenna with four pairs of log-periodic patterns as shown in FIG. 1A, a broadband antenna LP2 with two pairs of log-periodic patterns, and a broadband antenna LP0 without any log-periodic pattern, all of which have the similar structure as the one shown in FIG. 1, were manufactured and measured in frequency band and gain characteristics.

Referring to FIG. 5A, no change is exhibited with the number of log-periodic patterns, but as shown in FIG. 5B, the gain characteristics are improved with the increase of the number of log-periodic patterns.

As described above, in the broadband antenna according to this embodiment, the log-periodic patterns are advantageous for improvement of antenna gain characteristics.

To confirm the effect of the portions of the second radiator pattern extending to the side surfaces of the insulating block as shown in FIG. 1A, a broadband antenna with the extending portions (hereinafter, referred to as "side patterns") of the second radiator pattern to the side surfaces of the insulating block and a broadband antenna without the extending portions were manufactured and measured in gain characteristics.

Figure 6A:
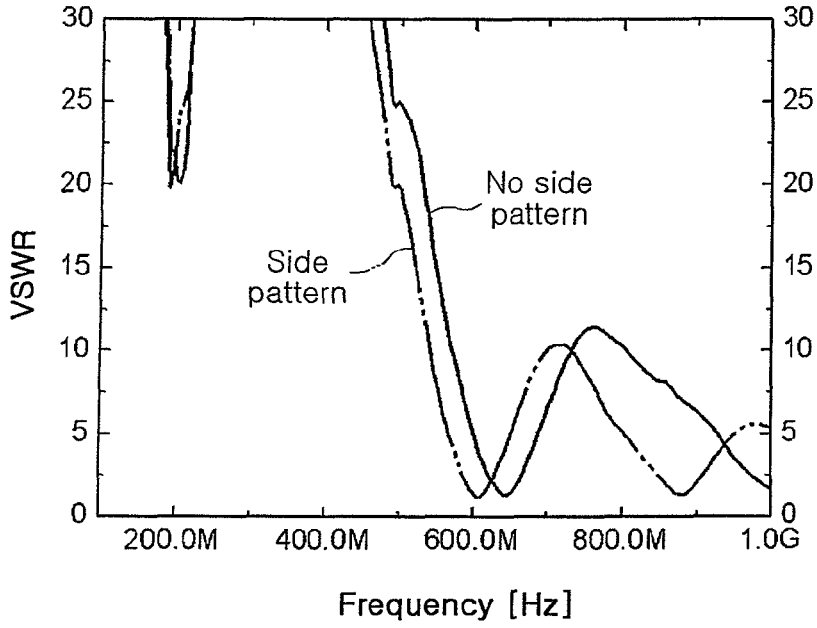
FIGS. 6A and 6B are graphs showing changes in frequency and gain depending on whether or not the broadband antenna illustrated in FIG. 1 has a side pattern portion.
Figure 6B:
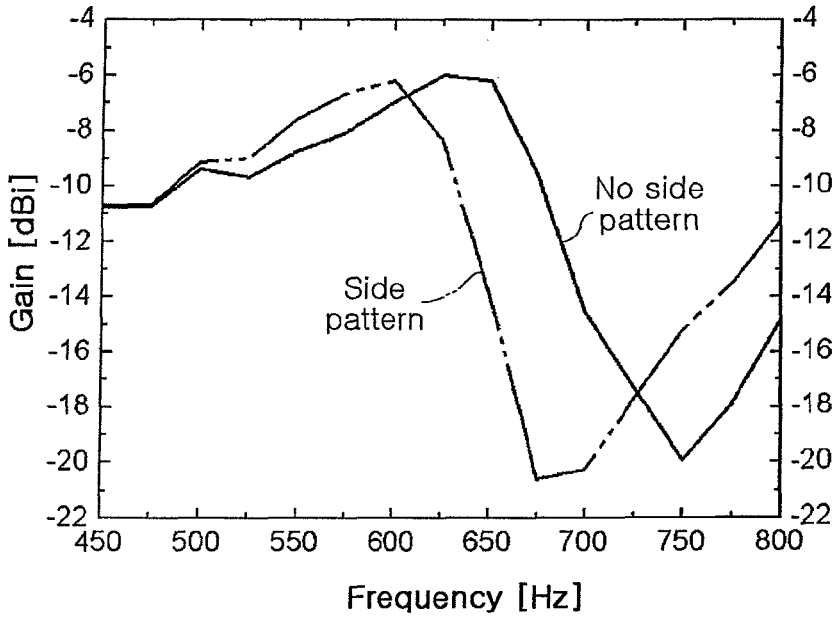

FIGS. 6A and 6B are graphs showing changes in frequency and gain with or without the side patterns in the broadband antenna with the same structure as shown in FIG. 1.

Referring to FIG. 6A, the broadband antenna with the side pattern forms a higher frequency band than the broadband antenna without the side pattern. In terms of the gain characteristics shown in FIG. 6B, when only the band of interest, DVB-H (475 to 750 MHz) is considered, the broadband antenna without the side pattern is lower than the broadband antenna with the side pattern.

As described hereinabove, this can be understood that in a miniaturized structure, where the insulating block has a size of 4×1×2.5 cm, the side patterns increase the parasitic capacitance with the first radiator pattern, thereby weakening the main current path extending via the first and second radiator patterns.

Figure 7:
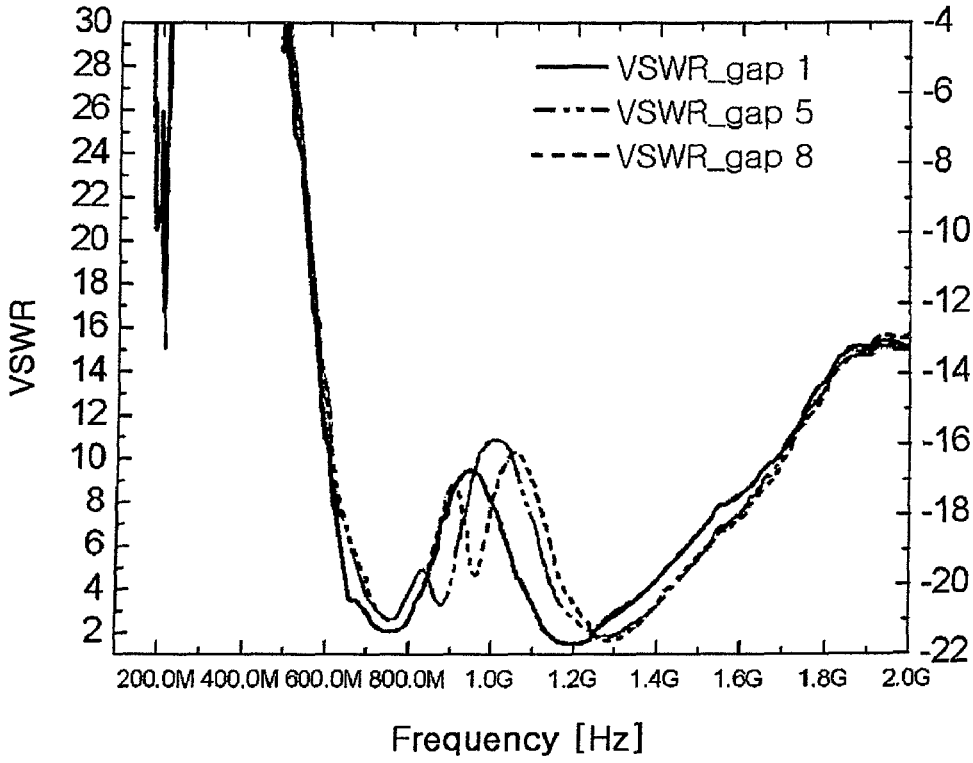
FIG. 7 is a graph illustrating a change in frequency characteristics according to an interval between the second radiator patterns and a length of a slot in the broadband antenna shown in FIG. 1.

FIG. 7 is a graph showing a change in the frequency characteristics with the varying interval of the second radiator pattern in the broadband antenna shown in FIG. 1.

The frequency mode of the broadband antenna according to this embodiment may be divided into two types. As shown in FIG. 7, the first mode (700 to 800 MHz) is formed by the first radiator pattern, and the second mode (1.2 to 1.3 GHz) is formed by the second radiator pattern.

In FIG. 7, the interval of the second radiator pattern appears to not affect the first mode whereas it affects the second mode. That is, it is confirmed that by controlling the second radiator pattern, it is possible to design a broadband antenna capable of covering a desired dual band. In the case of T-DMB or DVB-H actually, side frequencies like L band (1.4 GHz), besides the main frequency used in hundreds of MHz range, is required often times, to which the present invention can be advantageously applied.

Under the same overall conditions of the structure of the antennas, the length of the slot was varied to 5 mm, 20 mm and 35 mm as shown in FIG. 1. The result of measuring the frequency characteristics according to the length of the slot is shown in the graph of FIG. 8.

Figure 8:
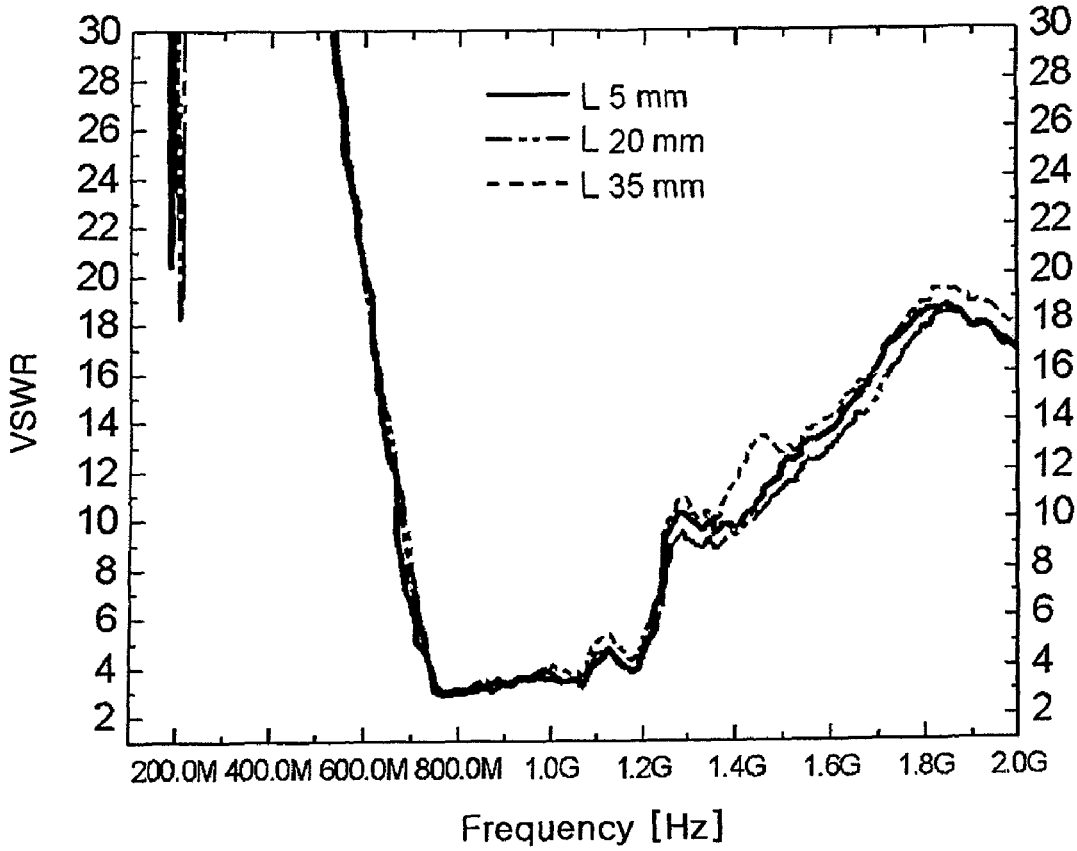
FIG. 8 is a graph illustrating a change in frequency characteristics according to a length of the slot formed in the first radiator in the broadband antenna shown in FIG. 1.

As shown in FIG. 8, the effect of the length of the slot is not significant. Such a result indicates that a large tolerance is permitted in forming the slot of the first radiator pattern in the antenna according to an exemplary embodiment of the present invention.

As described above, in the broadband antenna according to the present invention, the antenna characteristics may be maintained consistent despite the errors inevitable in the actual manufacturing process.

Figure 9:
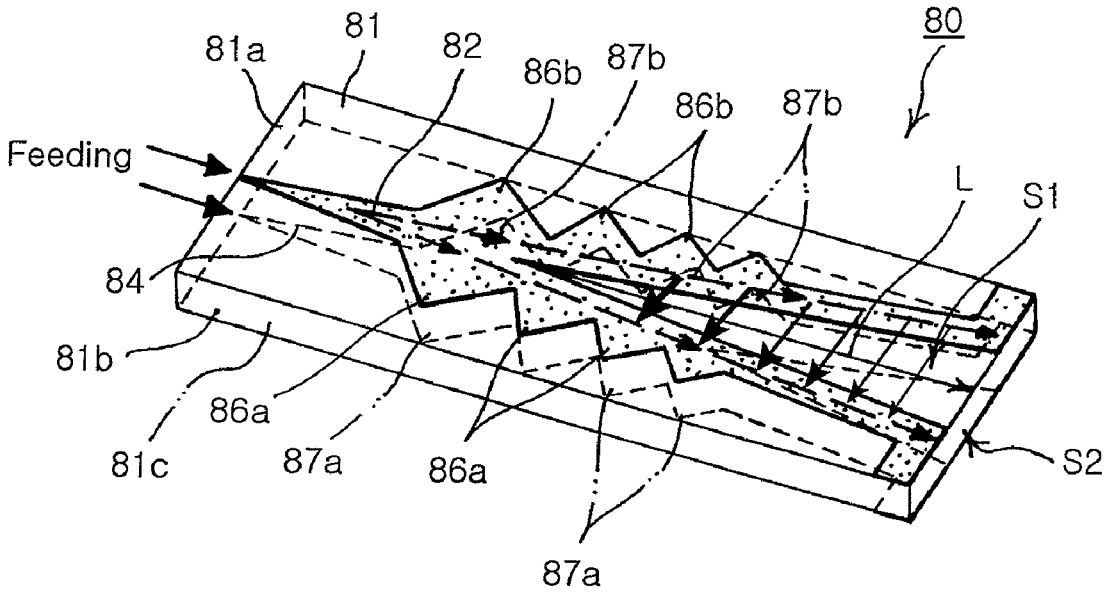
FIG. 9 is a perspective diagram illustrating a broadband antenna according to another exemplary embodiment of the present invention.

FIG. 9 is a perspective diagram illustrating a broadband antenna according to another embodiment of the present invention.

As shown in FIG. 9, the broadband antenna 80 according to this embodiment includes opposing first and second main surfaces 81*a* and 81*b*, an insulating block 81 having a side surface 81*c* between the two main surfaces, and first and second radiator patterns 82 and 84 formed on the first and second main surfaces 81*a* and 81*b*, respectively.

In this embodiment, unlike the above-described embodiments, the first radiator pattern 82 may be physically separated from the second radiator pattern 84. In this structure, the first and second radiator patterns have respective feeding points. Such feeding points may be formed at corresponding locations of the first and second radiator patterns, and particularly, provided at tips of the V-shaped first and second radiator patterns, respectively.

The first and second radiator patterns 82 and 84 include tapered slots S1 and S2 having open ends in the corresponding positions, respectively. Also, as shown in FIG. 9, the first and second radiator patterns 82 and 84 are symmetrical about the direction, in which the slots S1 and S2 are formed, as a reference axis, having almost the same shape.

As described hereinabove, a decrease of impedance and a change of electric field may occur along the current path due to the tapered slots S1 and S2 formed in the first and second radiator patterns 82 and 84, thereby exhibiting broadband characteristics.

Figure 10:
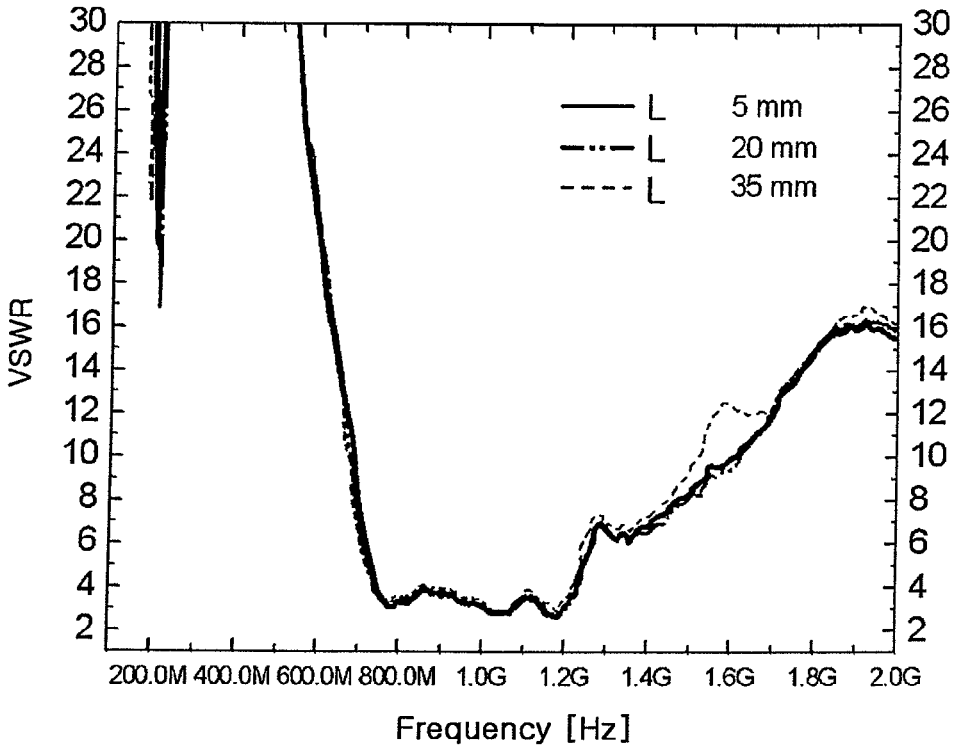
FIG. 10 is a graph showing a change in frequency characteristics according to a length of the slots formed in the first and second radiators in the broadband antenna shown in FIG. 9.

FIG. 10 illustrates frequency characteristics of the broadband antenna shown in FIG. 9, and shows the frequency changes according to the length (L=5 mm, 20 mm, 35 mm) of the slots formed in the first and second radiator patterns.

Referring to FIG. 10, the frequency bandwidths are significantly improved from the previous embodiments. However, the frequency bands are somewhat high, which can be however improved by mounting additional passive devices with the antenna, thereby advantageously utilizing the ultra-widened frequency bandwidth characteristics.

As shown in FIG. 10, the effect of the length of the slot is not significant. Such a result indicates that relative tolerance is large in forming the slot of the first radiator pattern according to this embodiment of the present invention.

As described above, in the broadband antenna according to this embodiment, the antenna characteristics may be consistently maintained according to the errors inevitably generated during an actual manufacturing process, similar to the above-described embodiments.

Figure 11:
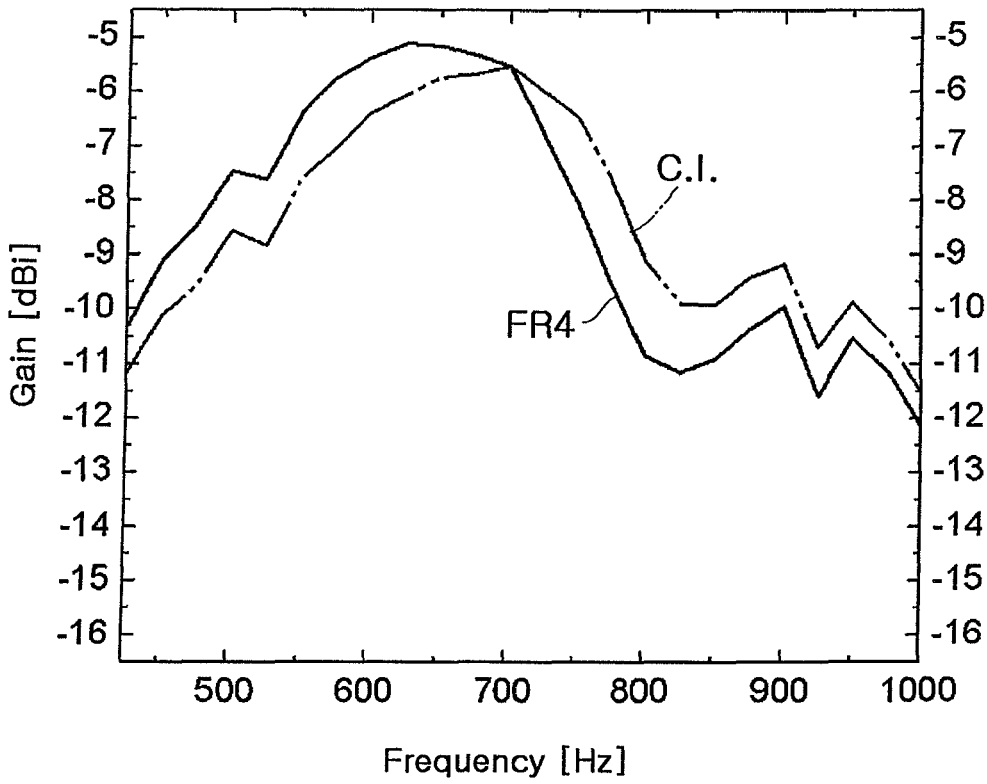
FIG. 11 is a graph showing a change in frequency gain according to a material of an insulating block in the broadband antenna shown in FIG. 9.

FIG. 11 is a graph illustrating a change of the frequency gain according to a material of the insulating material of the broadband antenna shown in FIG. 9.

First, one sample of a broadband antenna denoted by FR4, similar to the antenna shown in FIG. 9, is manufactured by forming the insulating block with FR4, which is the main material of a typical printed circuit board. Another sample of a broadband antenna, denoted by C.I, is manufactured by forming the insulating block with Teflon, which is a compound material, as a main material, with a small amount of carbonyl iron added as a magnetic material.

As shown in FIG. 11, the broadband antenna (C.I) using the magnetic dielectric compound material exhibited better gain characteristics overall in a resonant frequency band (600 MHz or higher) than the broadband antenna using FR4. However, the antenna structure according to the present invention may advantageously employ the block formed of the magnetic dielectric compound material as well as the block formed of FR4.

Figure 12A:
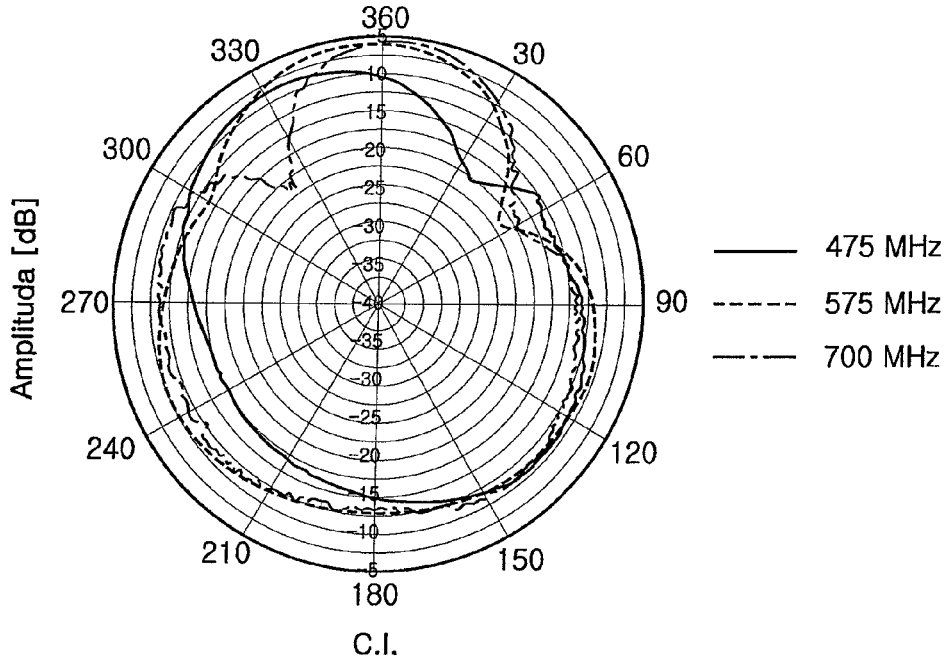
FIGS. 12A and 12B are diagrams of radiation patterns of broadband antennas having insulating blocks formed of different materials from that of the antenna shown in FIG. 9.
Figure 12B:
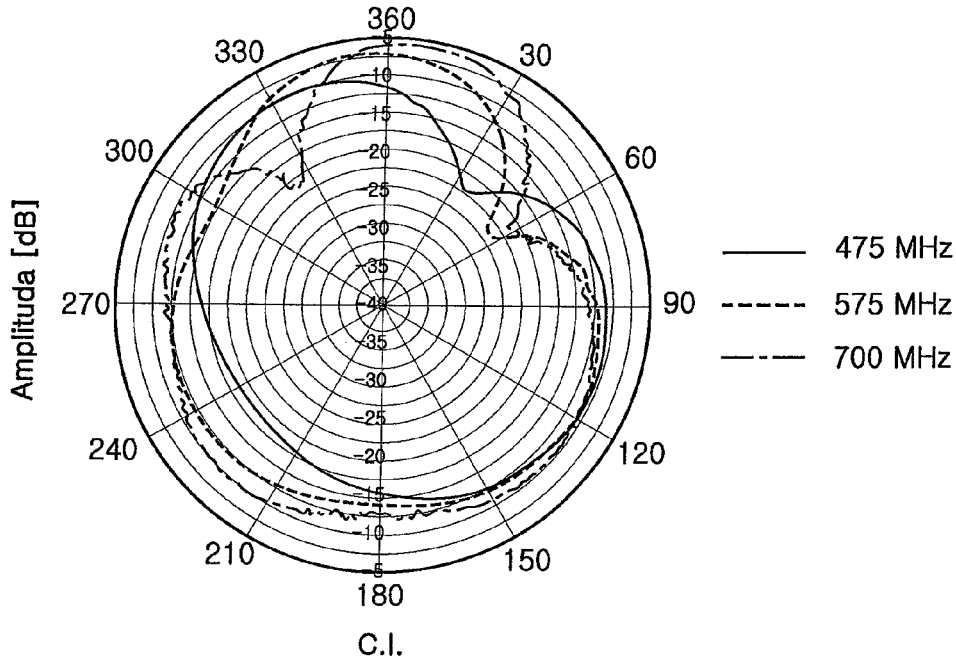

The radiation patterns of the two antennas were measured and the results are shown in FIGS. 12A and 12B. Not only in the radiation pattern shown in FIG. 12A, but also the radiation pattern shown in FIG. 12B exhibited omni-directional radiation characteristics suitable for a mobile communication terminal such as a mobile phone.

The present invention as set forth above provides a super broadband antenna capable of covering a large band range in a low frequency range with a miniaturized structure including a tapered slot, thereby enabling a built-in antenna covering T-DMB (174 to 216 MHz) and DVB-H (475 to 750 MHz).

While the present invention has been shown and described in connection with the exemplary embodiments, it will be apparent to those skilled in the art that modifications and variations may be made without departing from the spirit and scope of the invention as defined by the appended claims.

What is claimed is:

1. A broadband antenna comprising:

an insulating block having opposing first and second main surfaces and side surfaces between the first and second main surfaces;

a first radiator pattern formed on the first main surface and having a tapered slot with an open end; and a second radiator pattern comprising two patterns connected to opposing ends of the first radiator pattern at the side of the open end of the slot, respectively, and extending to the second main surface.

2. The broadband antenna of claim 1, wherein the first and second radiator patterns are symmetrical about a direction in which the slot is formed as a reference axis.

3. The broadband antenna of claim 2, wherein the two patterns of the second radiator pattern are disposed in parallel to each other.

4. The broadband antenna of claim 2, wherein the two patterns of the second radiator pattern have an interval widening in an opposite direction from the open end of the slot.

5. The broadband antenna of claim 1, wherein the first radiator pattern has a width increasing toward the open end of the slot in a V-shape.

6. The broadband antenna of claim 5, wherein a feeding portion is provided in an area adjacent to a tip of the first radiator pattern.

7. The broadband antenna of claim 5, wherein the first radiator pattern has at least one pair of log-periodic patterns formed in opposing positions of opposing sides thereof.

8. The broadband antenna of claim 1, wherein a feeding portion is provided at one end of the two patterns of the second radiator pattern.

9. The broadband antenna of claim 1, wherein the second radiator pattern has portions extending to the side surfaces of the insulating block.

10. The broadband antenna of claim 1, the insulating block is formed of a compound material of a polymer resin containing magnetic material powder, and the compound material has a specific permeability of 2 to 100 and a relative permittivity of 2 to 100.

11. The broadband antenna of claim 10, wherein the magnetic material powder comprises at least one selected from a group consisting of Fe, Ni, Co, Mn, Mg, Ba, Sr and Zn.

* * * * *